US005767883A

United States Patent [19]

Castro et al.

[11] Patent Number: 5,767,883

[45] Date of Patent: Jun. 16, 1998

[54] INK JET PRINTING SYSTEM

[75] Inventors: Anthony Bruce Castro; Phillip Leroy Laffoon, both of Herrin; James Patrick Lawhorn, DuQuoin; Gary Todd Suits, Marion, all of Ill.

[73] Assignee: Diagraph Corporation, Herrin, Ill.

[21] Appl. No.: 206,447

[22] Filed: Mar. 4, 1994

[51] Int. Cl.[6] ..... B41J 2/175

[52] U.S. Cl. ..... 347/94; 417/44.2

[58] Field of Search ..... 347/94, 85, 54, 347/6; 138/31; 417/44.2, 38

[56] References Cited

U.S. PATENT DOCUMENTS

| | | | |
|---|---|---|---|
| 3,738,776 | 6/1973 | Debare | 417/38 |
| 4,212,591 | 7/1980 | Lamontagne | 417/38 |
| 4,340,896 | 7/1982 | Cruz-Uribe | 347/85 |
| 4,357,617 | 11/1982 | Shimazawa | 347/94 X |
| 4,388,630 | 6/1983 | Osaki | 347/94 X |
| 4,475,116 | 10/1984 | Sicking | 347/94 X |
| 4,652,222 | 3/1987 | Aiba | 347/94 X |

*Primary Examiner*—Joseph W. Hartary

*Attorney, Agent, or Firm*—Senniger, Powers, Leavitt & Roedel

[57] ABSTRACT

An ink jet printing system having an ink accumulator holding a supply of ink for delivery under pressure to printheads of the system, the volume of the supply decreasing as ink is delivered to the printheads, and a pump operable intermittently to pump ink from a supply to the accumulator when the volume in the accumulator decreases to a lower limit, operation of the pump being terminated when the volume in the accumulator increases to an upper limit.

15 Claims, 5 Drawing Sheets

INK JET PRINTING SYSTEM

BRIEF SUMMARY OF THE INVENTION

This invention relates to ink jet printing systems, and more particularly to an ink delivery system therefor.

The invention is in the same general field as the ink jet printing system shown in the coassigned Barney U.S. Pat. No. 4,792,817 entitled Ink Jet Printing Systems, issued Dec. 20, 1988. That system comprises a plurality of ink jet printheads each supplied with ink from an ink bottle (133), ink in the bottle being pressurized for delivery to the printheads by an air pressure input (135) connected to the bottle. While this type of ink delivery system is generally satisfactory insofar as operation of the printheads is concerned, it has drawbacks in that the printing system is put out of operation when the ink bottle has been emptied and is replaced by a fresh bottle, and in that the ink bottle requires pressurization. In addition to U.S. Pat. No. 4,792,817, reference may also be made to U.S. Pat. Nos. 4,555,719, 4,723,131 and 4,924,241.

Among the several objects of this invention may be noted the provision of an ink jet printing system with an improved means for supplying ink under pressure to the printhead or printheads of the system which enables quick, easy replacement of an emptied ink bottle with a fresh bottle without interrupting the operation of the printhead; and the provision of such a system which eliminates pressurization of ink in the ink bottle.

In general, an ink jet printing system of this invention comprises at least one ink jet printhead, and means for supplying ink under pressure to the printhead comprising an accumulator for holding a supply of ink under pressure for delivery to the printhead, said accumulator comprising expansible chamber means having an expansible and contractile chamber for containing ink and means pressurizing said expansible chamber means tending to decrease the volume of said chamber, a pump for pumping ink from an ink supply to said chamber, and means for effecting operation of the pump to deliver ink from said supply to said chamber in response to decrease in volume of said chamber to a predetermined lower limit resulting from delivery of ink from said chamber to said printhead and for cutting off operation of the pump in response to increase in volume of said chamber to a predetermined upper limit resulting from delivery of ink from said supply to said chamber.

Other objects and features will be in part apparent and in part pointed out hereinafter.

BRIEF DESCRIPTION OF THE DRAWINGS

Corresponding reference characters indicate corresponding parts throughout several views of the drawings.

DETAILED DESCRIPTION

Figure 1:
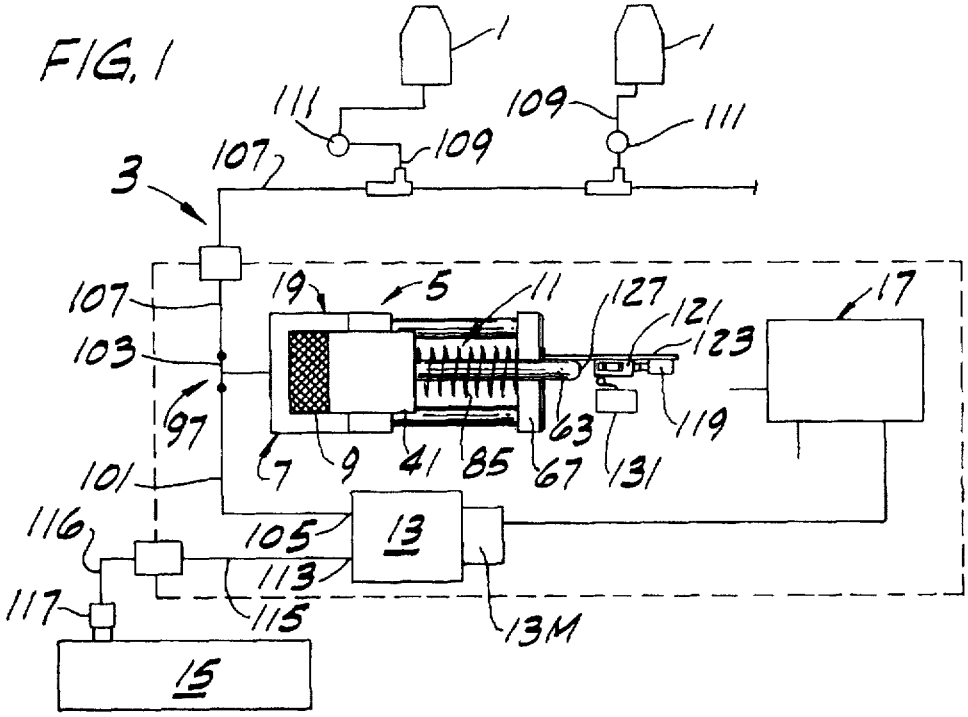
FIG. 1 is a diagram of the ink jet printing system of this invention.
Figure 2:
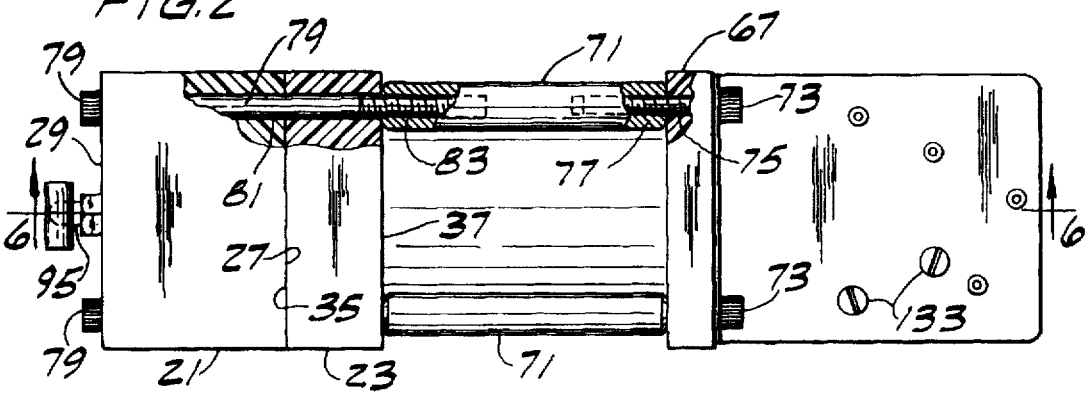
FIG. 2 is a top plan view of the accumulator per se, with parts broken away and shown in section.
Figure 3:
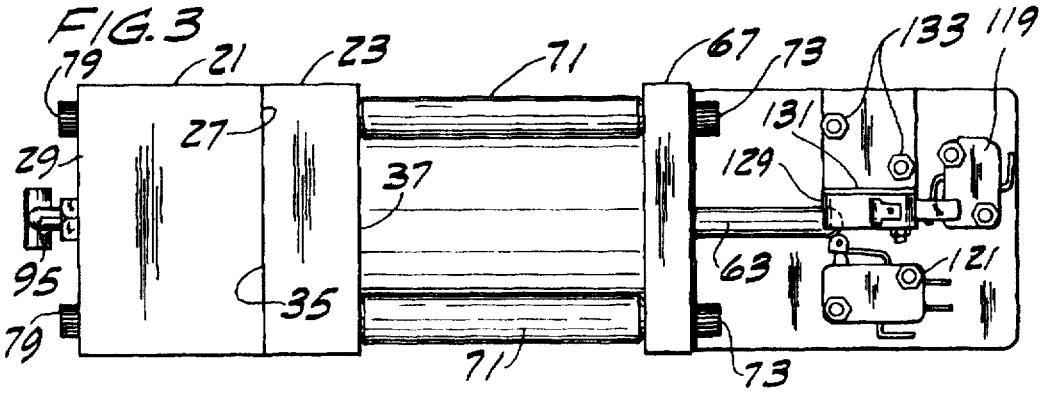
FIG. 3 is a bottom plan of FIG. 2.

Referring to the drawings, first more particularly to FIG. 1, an ink jet printing system of this invention is shown to comprise at least one printhead, and more particularly a plurality of printheads each designated 1, and means designated in its entirety by the reference numeral 3 for supplying ink under pressure to the printheads. Each printhead may be of the type shown in the aforesaid U.S. Pat. Nos. 4,723,131 and 4,924,241, which are incorporated herein by reference. At 5 is generally indicated the accumulator of the system for holding a supply of ink under pressure for delivery to the printheads. As will be subsequently described in detail, the accumulator 5 comprises expansible chamber means 7 having an expansible and contractile chamber 9 for containing ink and means 11 pressurizing said expansible chamber means tending to decrease the volume of the chamber 9 and acting to compress ink in the chamber. At 13 is indicated a pump for pumping ink from an ink supply 15 to the chamber 9, which is a variable volume chamber. At 17 is generally indicated means for effecting operation of the pump to deliver ink from said supply to said chamber in response to decrease in volume of said chamber to a predetermined lower limit resulting from delivery of ink from said chamber to said printhead and for cutting off operation of the pump in response to increase in volume of said chamber to a predetermined upper limit resulting from delivery of ink from said supply to said chamber.

Figure 6:
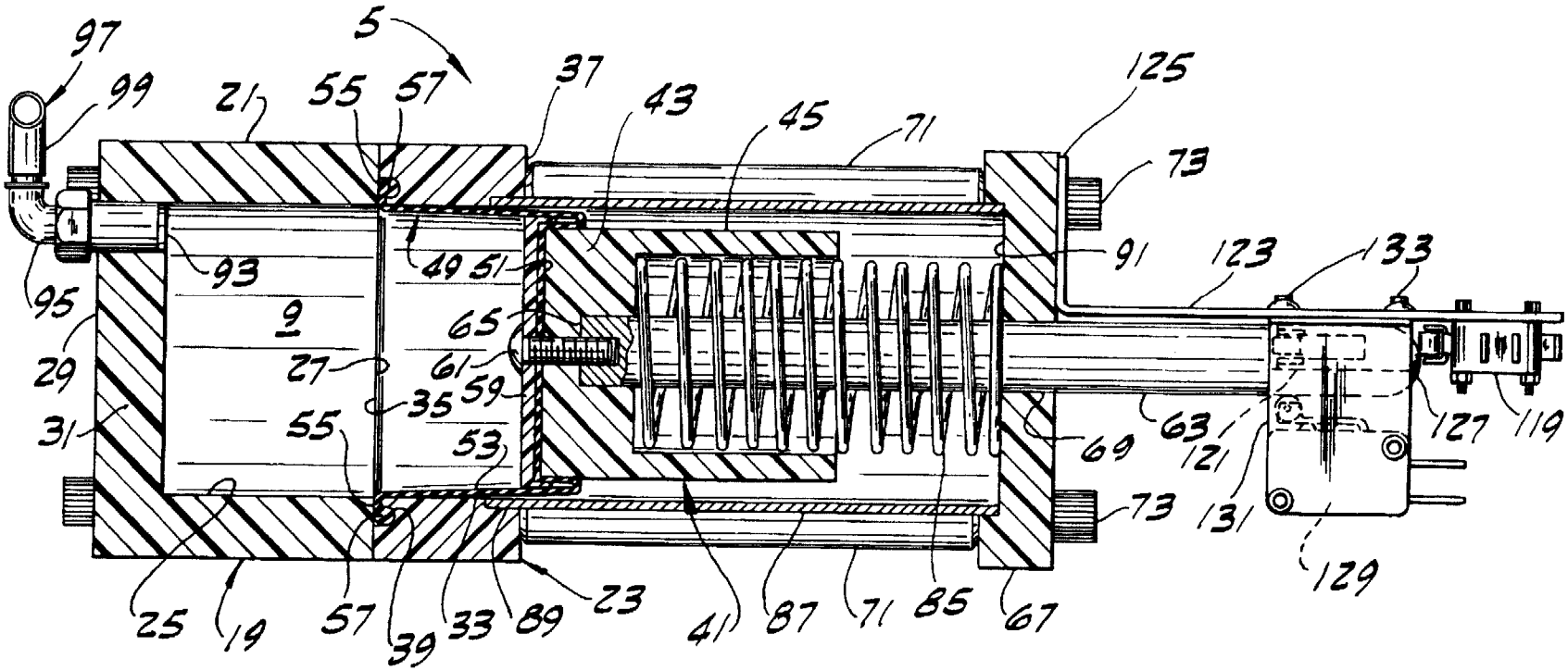
FIG. 6 is a central longitudinal vertical section of the accumulator taken on line 6—6 of FIG. 2.

In detail, the accumulator 5 comprises a body designated in its entirety by the reference numeral 19 having chamber 9 therein, and constituting a cylinder for holding a supply of ink under pressure. The body 19 is made in two parts designated 21 and 23, each of which may be molded of a suitable plastic. Part 21 comprises a block which is square in cross-section and which has a cylindrical recess 25 extending from one end face 27 of the block toward but terminating short of its other end face 29. The end face 27 is referred to as the rearward end face of the block; the end face 29 is referred to as the forward end face. Thus, "forward" means toward the left and "rearward" means toward the right as viewed in FIGS. 1–3 and 6. Recess 25 is open at its rearward end, and closed at its forward end by a wall 31 integral with the block. Part 23 comprises a block of square cross-section corresponding to the block 21, having a cylindrical opening 33 extending completely therethrough from its forward end face 35 to its rearward end face 37. An annular groove 39 (see FIG. 6) is formed in the forward end face of the block 23 surrounding the forward end of opening 33.

At 41 is indicated a member hereinafter referred to as a piston movable axially in the chamber 9 in block 21 and in the opening 33 in block 23. The piston, which may be molded of a suitable plastic, is of cup shape, having a circular forward end wall or head 43 and an annular wall 45 (a cylindrical skirt) extending rearward therefrom. The piston head 43 and the skirt 45 are coaxial with and of sufficiently smaller diameter than the cylindrical recess 9 in the block 21 and the cylindrical opening 33 in the block 23 as to provide for accommodation of sealing means generally designated 49 for the piston.

The sealing means 49 comprises a flexible diaphragm, more particularly a rubber diaphragm, generally of cup shape, having a circular forward end wall 51, and a relatively thin annular wall or skirt 53 extending axially from the periphery of the wall 51, with an outwardly extending annular flange 55 at the end of the skirt away from the end wall 51. Flange 55 is formed with a peripheral annular bead 57 which is received in the annular groove 39. The end wall 51, which corresponds in diameter to the diameter of the end wall 43 of the piston, is engaged flatwise with and compressed against the forward face of the end wall or head 43 of the piston by means of a circular cap 59 secured to the piston by means of a screw 61 extending through vertical holes in the cap, the diaphragm end wall 51 and the piston end wall 43 and threaded in a tapped hole in the forward end of a piston rod 63 extending rearward from a socket 65 which extends into the piston end wall 43 from its rearward side. The piston rod 63 extends rearward from the piston out of the skirt of the piston and rearward of the body 19, being slidable in a guide 67 outboard of the rearward end of the body 19. This guide comprises a square plate (it may be molded of plastic) having a central opening 69 in which the piston rod is slidable. The plate is held in assembly with the body 19 at some distance rearward of the rearward end of the body by means comprising four rods each designated 71 which extend between the rear face 37 of the block 23 and the forward face of the plate adjacent the four corners of the plate and block 23, and screws 73 extending through holes 75 in the plate adjacent the four corners of the plate and threaded in tapped holes in the rearward ends of the rods as indicated at 77 (see FIG. 2). Four elongate screws each designated 79 extend through holes 81 in the blocks 21 and 23 adjacent their four corners and are threaded in tapped holes in the forward ends of the rods 71 as indicated at 83. These long screws 79, as threaded in the forward ends of the rods 71, hold blocks 21 and 23 in assembly end-to-end with the bead 57 compressed between the blocks providing a seal for the chamber 9 at the joint between the two blocks and the end of the skirt 53 of the diaphragm.

The means 11 for pressurizing the expansible chamber means 7 comprises spring means, more particularly a coil compression spring 85 surrounding the piston rod 63 reacting from the plate 67 (serving as a spring abutment) against the piston 41 biasing the piston to move forward in the chamber 9 to decrease the volume of the chamber and thereby pressurize ink in the chamber. At 87 is indicated a housing for the piston and the spring comprising a metal tube extending between the rearward side of the body block 23 and the forward side of the plate 67. The opening 33 in the block 23 has a counterbore 89 at its rearward end and the plate 67 has a circular recess 91 in its forward face receiving the ends of the tube and holding it coaxial with the openings 33 and 69 (and coaxial with the piston rod and the spring).

The forward end wall 31 of the body block 21 has a port 93 therein for delivery of ink to and delivery of ink from the chamber 9. An elbow 95 is received in this port and a tee fitting 97 has its stem 99 connected to the elbow. At 101 (FIG. 1) is indicated a conduit for ink interconnected between one end of the head 103 of the tee 97 and the outlet 105 of the pump 13, for delivery of ink to chamber 9 by the pump. At 107 is indicated a conduit for ink connected to and extending from the other end of the head 103 of the tee 97 for delivery of ink from the chamber 9 to the printheads 1 via lines 109 branching off the conduit 101, each branch including an ink regulator 111. Ink is supplied to the inlet 113 of the pump 13 from the ink supply 15 via an ink supply line 115, including a length of flexible tubing 116, having a quick connect and disconnect coupling member 117 at its downstream end for quick connection to and quick disconnection from a mating coupling member on the ink supply 15 (which may be a bottle of ink). Member 117 is of a well-known type which is closed when disconnected from and which opens when connected to the mating member.

Figure 4:
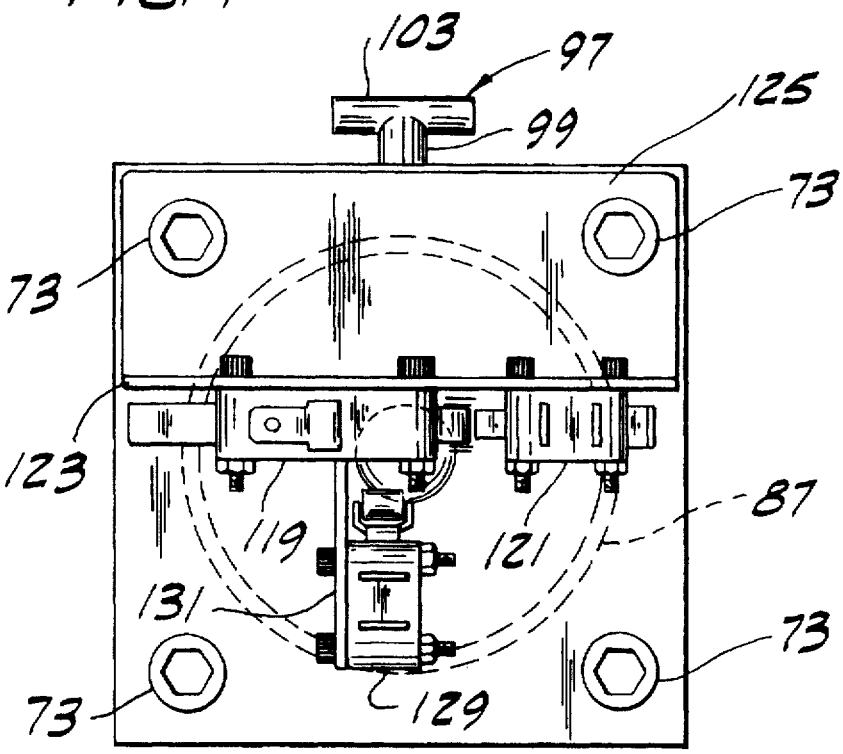
FIG. 4 is a view in elevation of the right end of the accumulator as shown in FIG. 2.
Figure 5:
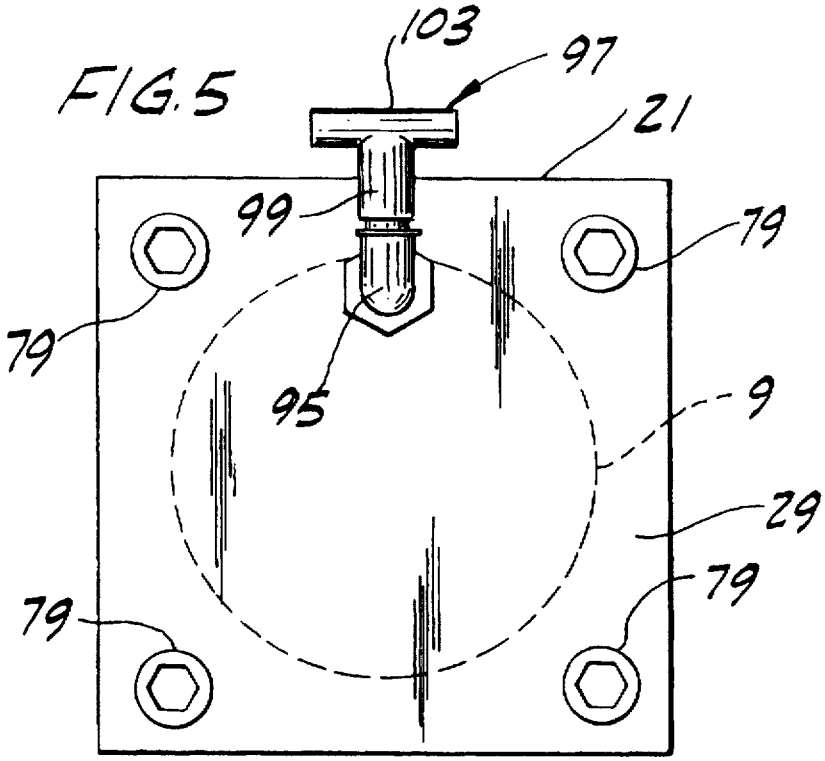
FIG. 5 is a view in elevation of the left end of the accumulator as shown in FIG. 2.

The pump 13 is driven by an electric motor diagrammatically indicated at 13M, the aforesaid means 17 being operable to energize the motor to drive the pump when the volume of the expansible and contractile chamber 9, as determined by the position of the piston 41, decreases to a predetermined lower limit, thereby delivering ink under pressure from the ink supply 15 to the chamber 9. As ink is delivered under pressure to chamber 9, the piston 41 is forced to move rearward by the pressure of the ink against the forward bias of the spring 85 on the piston, the volume of the chamber thereby increasing. The pump delivers ink under such pressure as to overcome the bias of the spring. The pump continues in operation until the volume of chamber 9 (i.e., the volume of ink in the accumulator) increases to a predetermined upper limit, and is then deenergized. For this mode of operation, the means 17 includes first and second limit switches 119 and 121, each of which is of the type having a double-throw operating arm having a roller thereon, for controlling the pump motor, these switches being actuated and deactuated by the piston rod 63 in accordance with the position of the piston rod and hence in accordance with the position of the piston 41 (reflecting the volume of the chamber 9). These switches are mounted on the bottom of a bracket constituted by a plate 123 having a flange 125 secured on the outside of the plate 67 by the two upper screws 73 with the switches at the level of the piston rod 63. The first switch 119 is mounted on the bottom of the plate 123 in position for engagement of the roller on its operating arm by the rearward end 127 of the piston rod 63 when the piston 41 and the piston rod 63 are in a rearward limit position of maximum volume of chamber 9, the parts being illustrated in this maximum volume position in FIG. 6. In this position of the parts, the diaphragm 49 is pulled back from its forward end at 55 and extends rearwardly to some extent out of the opening 33 in the rearward body part 23. The second switch 121 is mounted on the bottom of the plate 123 forward of and at right angles to switch 119 in position for engagement of the roller on the operating arm of switch 121 by one side of the piston rod 63 as the piston rod moves forward from its stated rearward limit position (FIG. 6) to a point where the volume of the chamber 9 is decreased to a predetermined lower limit such as shown in FIG. 1 the pressure of ink in chamber 9 also being decreased to a predetermined lower limit, e.g. 13 p.s.i. At this point, the rearward end 127 of the piston rides off the roller of switch 121, which results in operation of the pump 13 to pump ink into chamber 9. At 129 is indicated a third switch, which may be referred to as the "kill switch" for cutting off ("killing") the operation of the pump on forward overtravel of the piston 41 and piston rod 43, such as may occur due to rupture of line 107. This switch is of the double-throw type having an operating arm with a roller thereon. It is mounted on a bracket 131 attached to plate 123 as indicated at 133 on the bottom thereof, in position for engagement of the roller on its operating arm by the bottom of the piston rod 63 as the piston rod moves forward to a point just forward of the roller on the operating arm of switch 121, at which point the rearward end 127 of the piston rod 63 rides off the roller on the operating arm of switch 129 to allow the switch to open. The switch 129 is illustrated in FIG. 7 for convenience as positioned horizontally, whereas it is actually positioned with its operating arm and roller at the top as appears in FIGS. 1, 3 and 4.

Figure 7:
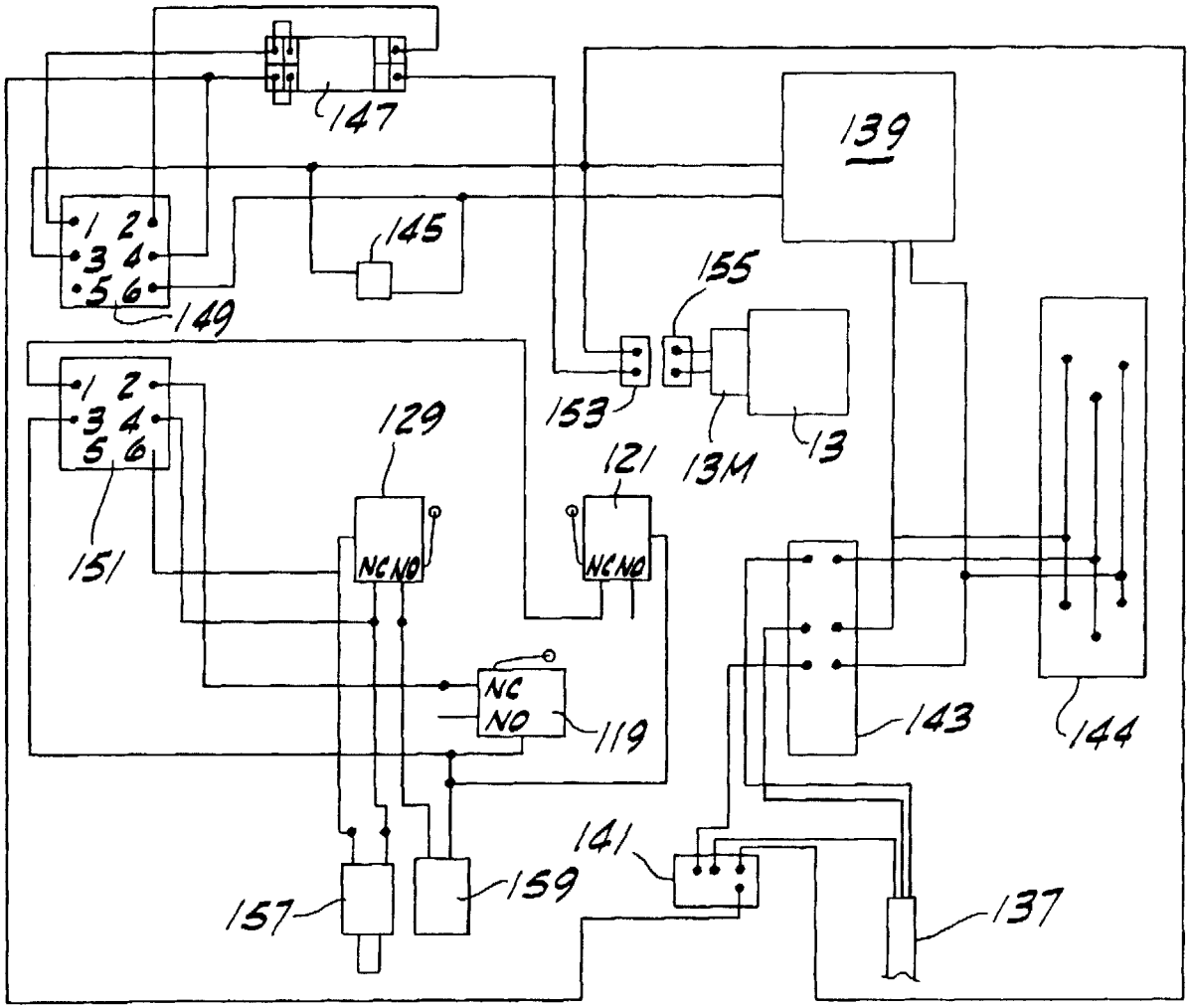
FIG. 7 is a wiring diagram.
Figure 8:
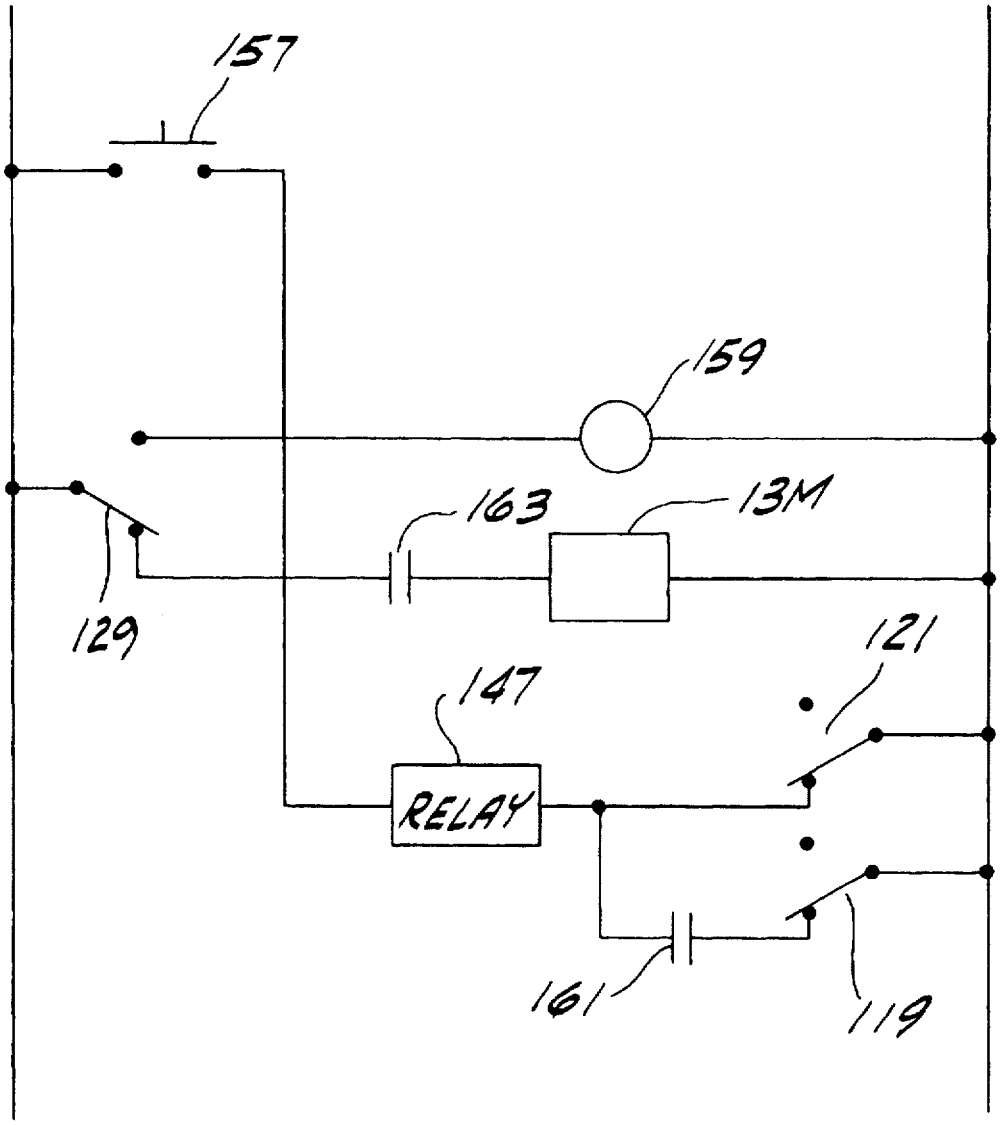
FIG. 8 is a simplified showing of circuitry illustrated in FIG. 7.

The motor 13M for the pump 13, the rearward and forward limit switches 119 and 121 and the switch 129 are interconnected in the circuit 135 diagrammed in FIG. 7 (see also FIG. 8). This circuit comprises a power cord 137 for connection to an A.C. source, a transformer 139 supplied from the power cord via wiring including an on-off switch 141 and a terminal strip 143. An alternate power source may be established via a power strip 144. The circuit further comprises a rectifier 145 fed by the transformer and a relay 147 which is under control of the limit switches 119 and 121 and which controls operation of the pump motor 13M. Items indicated at 149 and 151 in the circuit are terminal strips shown separated. Each has terminals 1–6, the terminal 1 on one strip mating with the terminal 1 on the other, terminal 2 on one strip mating with terminal 2 on the other, etc. Items 153 and 155 are connectors, shown separated, for connection to the pump motor 13M. At 157 is indicated a switch operable to by-pass the switch 129 for operating the pump 13 to supply ink to chamber 9 to start operations. At 159 is indicated a signal, e.g. a strobe light, to signal that switch 129 has been tripped to kill operation of the pump. The relay 147 has a set of contacts 161 in series with the upper limit switch 119 and a set of contacts 163 in series with the pump motor 13M and the switch 157.

To start operation of the accumulator, switch 157 is actuated, resulting in actuation of the relay 147 via switch 121 to close contacts 161 and 163. The relay latches itself in via contacts 161 and switch 119. With relay contacts 163 thus closed, the pump motor 13M is energized to drive the pump 13 thereby delivering ink under pressure to the chamber 9 of the accumulator. If the piston rod started in a forward position wherein its rearward end was forward of the operating roller of switch 129, as soon as its rearward end engages this operating roller it trips switch 129 to the position (FIG. 8) where it completes a circuit for the pump motor through the closed contacts 163 and the start switch 157 may then be released, the pump continuing in operation. As the chamber 9 fills with ink, the piston 41 and the piston rod 63 are driven rearward to the point where the piston rod actuates switch 119, which opens the relay circuit thereby opening contacts 163 and stopping the pump. At this point, the chamber 9 is at maximum volume full of ink at a predetermined maximum pressure, e.g. 17 p.s.i. Spring 85 biases the piston 41 forward tending to decrease the volume of chamber 9 and pressurizing ink therein tending to force the ink out of chamber 9 via port 93, elbow 95, tee 97 and line 107 to branch lines 109 feeding the printheads 1. As the printheads deliver jets of ink in the course of their operation, the piston 41 moves forward under the bias of spring 85 in accordance with the discharge of ink from chamber 9, with resultant decrease in the volume of chamber 9. When the volume decreases to the stated predetermined lower limit such as illustrated in FIG. 1, the piston rod 63 reaches the point where its rearward end 127 rides forward off the roller of switch 121, and this switch is thereby thrown to a closed position wherein the relay 147 is energized. The relay thereupon establishes the circuit for the pump motor 13M, and the pump 13 is thereupon driven to pump ink under pressure from the ink supply 15 to chamber 9 via lines 116, 115 and 101 and the tee 97, elbow 95 and the port 93 in the forward end wall 31 of the body 19 of the accumulator. Ink delivered under pressure to chamber 9 drives piston 41 and the piston rod 63 back rearward, increasing the volume of the chamber. The relay 147 remains latched in for maintaining the pump motor 13M energized until the rearward end 127 of the piston rod 63 engages the roller of the rearward limit switch 119 and opens it, which deenergizes the relay and cuts off the motor. Thus, the accumulator is recharged with a full volume of ink, and the process repeats itself. It will be observed that the pressure of ink in chamber 9 is maintained between 13 p.s.i. and 17 p.s.i., for example.

The system is such that the ink supply line 116, 115 may be disconnected from the ink supply (bottle) 15 when the latter is emptied, a fresh ink supply (bottle) set in place replacing the empty bottle, and the ink supply line 116, 115 connected to the fresh ink supply while the accumulator continues during the changeover to the fresh supply to supply ink to the printheads without interruption. Thus, during the changeover, the piston 41 under the bias of the spring 85 continues to force ink under pressure out of the chamber 9 for delivery via line 107 and branch lines 109 to the printheads.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An ink jet printing system comprising at least one ink jet printhead and means for supplying ink under pressure to the printhead wherein said means comprises:

an accumulator for holding a supply of ink under pressure for delivery to the printhead, said accumulator comprising expansible chamber means comprising a body having a chamber therein, and a member movable in one direction in said chamber for decreasing the volume of said chamber and in the opposite direction for increasing the volume of said chamber, said chamber being ported for delivery of ink thereinto from an ink supply and for delivery of ink under pressure therefrom to said printhead;

means for exerting force on said member for biasing it for movement in said one direction in said chamber for pressurizing ink filling said chamber to capacity and for forcing ink out of said chamber for delivery to said printhead on demand for ink by said printhead;

a pump for pumping ink from an ink supply to said chamber; and means for effecting operation of the pump to deliver ink from said supply to said chamber in response to decrease in volume of said chamber and in the corresponding volume of ink therein to a predetermined lower limit resulting from delivery of ink from said chamber to said printhead and for cutting off operation of the pump in response to increase in volume of said chamber and in the corresponding volume of ink therein to a predetermined upper limit resulting from delivery of ink from said supply to said chamber to fill said chamber to capacity.

2. An ink jet printing system as set forth in claim 1 wherein said means for exerting force on said member comprises spring means biasing said member to move in said one direction.

3. An ink jet printing system as set forth in claim 2 having an ink supply line connected to the pump and connectable to and disconnectable from the ink supply for supplying ink to the pump from said ink supply, and an ink delivery line connected to the pump for delivery of ink from the pump to the said chamber.

4. An ink jet printing system as set forth in claim 3 wherein the ink supply line has an end with a quick connect and disconnect coupling member for quick connection to and quick disconnection from the ink supply.

5. An ink jet printing system as set forth in claim 2 wherein said chamber is a cylindrical chamber having a forward end and a rearward end, and said movable member comprises a piston movable axially in the chamber, said spring means biasing the piston to move forward in the chamber, and said system having sealing means for the piston.

6. An ink jet printing system as set forth in claim 5 wherein said sealing means comprises a generally cup-shaped flexible diaphragm having an annular wall extending axially in said cylindrical chamber, said diaphragm having its said annular wall secured at one end thereof constituting its forward end to the piston in sealed relation with respect to the piston with said annular wall in surrounding relation with respect to the piston and secured at its other end to the body adjacent the rearward end of the body in sealed relation with respect to the body, said system further having a piston rod extending from the piston out of the rearward end of said body, said spring means comprising a coil compression spring surrounding the piston rod acting against the piston to bias it forward in the said chamber.

7. An ink jet printing system as set forth in claim 6 wherein the piston is generally of cup shape having a forward end wall and an annular wall extending back from the forward end wall, the diaphragm having its forward end wall engaging and secured to the forward end wall of the piston.

8. An ink jet printing system as set forth in claim 7 wherein the body comprises a forward part having a chamber extending forward from one end thereof constituting its rearward end and a rearward part having an opening therein extending from one end thereof constituting its forward end to its other end constituting its rearward end, said forward and rearward parts being secured together end-to-end with the said other end of the diaphragm having a portion clamped between the rearward end of said forward part of the body and the forward end of said rearward part of the body.

9. An ink jet printing system as set forth in claim 8 wherein the piston rod extends rearward out of the said rearward part of the body, and wherein the accumulator has a guide for the piston rod outboard of the body, spaced from the rearward end of the body, said guide having an opening in which the piston rod is slidable, the spring surrounding the piston rod between the guide and the piston and reacting from the guide.

10. An ink jet printing system as set forth in claim 1 wherein the pump is driven by an electric motor and wherein the means for effecting operation of the pump comprises a first limit switch operable in response to increase in volume of said chamber to said predetermined upper limit, a second limit switch operable in response to decrease in volume of said chamber to said predetermined lower limit, said switches being connected in a circuit for starting the pump motor on actuation of the second limit switch and holding the motor in operation until the first switch is actuated.

11. An ink jet printing system as set forth in claim 6 wherein the pump is driven by an electric motor and wherein the means for effecting operation of the pump comprises a first limit switch operable in response to increase in volume of said chamber to said predetermined upper limit, a second limit switch operable in response to decrease in volume of said chamber to said predetermined lower limit, said first switch being located outside the body and operable by the piston rod on rearward movement thereof to the point where the volume of said chamber is increased to said upper predetermined limit, said second switch being located outside the body rearward thereof and operable by the piston rod upon forward movement of the piston rod to the point where the volume of said chamber is decreased to said predetermined lower limit.

12. An ink jet printing system as set forth in claim 11 wherein the piston rod extends rearward out of the said rearward part of the body, and wherein the accumulator has a guide for the piston rod outboard of the body spaced from the rearward end of the body, said guide having an opening in which the piston rod is slidable, the spring surrounding the piston rod between the guide and the piston and reacting from the guide.

13. An ink jet printing system as set forth in claim 12 having a bracket mounted on and extending rearward from said guide, said switches being mounted on said bracket in position for actuation thereof by the piston rod.

14. An ink jet printing system as set forth in claim 13 wherein the first limit switch is positioned for actuation thereof by the rearward end of the piston rod as the piston rod moves rearward to the point where the volume of said chamber is increased to said upper predetermined limit, and wherein the second limit switch is positioned forward of the second for actuation thereof as the rearward end of the piston rod travels forward past said second limit switch.

15. An ink jet printing system as set forth in claim 14 further having a third switch positioned for actuation thereof by the piston rod as the rearward end of the piston rod travels forward past said second limit switch for cutting off operation of the pump.

* * * * *